United States Patent [19]

Auten

[11] Patent Number: 4,834,260

[45] Date of Patent: May 30, 1989

[54] BAG HOLDER WITH PENETRATING GRIPPERS

[76] Inventor: Howard L. Auten, P.O. Box 3313, Boynton Beach, Fla. 33424–3313

[21] Appl. No.: 127,151

[22] Filed: Dec. 1, 1987

[51] Int. Cl.[4] ..... B65D 25/16

[52] U.S. Cl. ..... 220/404; 220/1 T

[58] Field of Search ..... 220/404, 403, 1 T, 85 R; 248/99, 100

[56] References Cited

U.S. PATENT DOCUMENTS 4,535,911 8/1985 Goulter ..... 220/1 T X
4,558,800 12/1985 Isgar et al. ..... 220/1 T X
4,576,310 3/1986 Tsgar et al. ..... 220/1 T X
4,589,570 5/1986 Auten ..... 220/404
4,735,340 4/1988 Preston ..... 220/1 T X

*Primary Examiner*—Steven M. Pollard
*Attorney, Agent, or Firm*—Andrew F. Blum

[57] ABSTRACT

A container such as a rigid rubbish can suitable to support plastic liner bag containers and equipped with penetrating grippers located around the outside peripheral wall to retain the draped over portion of the liner bag from slipping limply inside during use. The penetrating grippers may be of a flexible material and pointed to penetrate, wedge, and grip bag flap material. The bag penetrating grippers may also be sold separately for after market installation on existing containers.

18 Claims, 1 Drawing Sheet

BAG HOLDER WITH PENETRATING GRIPPERS

FIELD OF THE INVENTION

This invention is an improved means for securely holding liner bags placed over the rim of containers by means of pointed penetrating grippers affixed to the outer container wall whereby bag flap material may be quickly pulled or pushed upward into a locking engagement with the penetrator and between it and the outer wall of the container.

PRIOR ART

For many years fabric or film type bags have been supported by a framework or rim device having metal hooks or clamps affixed to the top of the rim or outside and below the outer peripheral rim. Today the thin sheet plastic film liner bags often slip or tear off the older devices designed to hold bags in an open position.

The means, U.S. Pat. No. 711,411 portrays sharp metal hooks below a rim of a skeleton metal framework. They will hold heavy fabric bags but thin plastic bags quickly tear off these type of hooks. The Gitts, U.S. Pat. No. 3,604,677 portrays clip-like hooks as part of an upstanding metal leg which must be pressed into the ground for support. The design of relatively heavy framework precludes any pronounced flexibility of the clip structure and bags can easily tear off of the narrow clip surface. Hawk, U.S. Pat. No. 3,784,049 attempts to retain disposable bags by having the marginal edge rolled in a curve socket to lock in an engagement with the container. The Isgar U.S. Pat. No. 4,576,310 discloses notches and hooks and would appear to work well for the plastic grocery bags with handles for which it was specifically designed. Nowhere is there any indication of the rectangular shaped hooks mounted by means of notches having any bag penetrating or perforating capability or of wedging bag material between the hooks and the container wall. The Auten U.S. Pat. No. 4,589,570 discloses the basic new principle of rim projections which penetrate and may perforate the liner bag flap held under the over-hanging container rim. Stress is widely dispersed so bags do not tear off.

BRIEF SUMMARY

The basic object of this invention is to equip a plastic bag container with outer wall mounted bag penetrating grippers designed to firmly hold bag material laid over its rim.

It is also an object of this invention to provide a relatively wide and upwardly narrowing wedge shaped slot to grip and trap penetrated bag material between the outer container wall and the wide inside surface of the penetrator.

It is an object of this invention to provide bag containers with their outer wall contour shaped to provide better location and operation of grippers affixed to the outer wall of the bag container.

It is also an object of the invention to provide various means of attaching bag holding penetrating grippers to bag holding containers made of many different materials and degrees of flexibility.

It is an object of this invention to provide bag penetrating grippers for after market installation on containers.

These and other features and advantages will be disclosed in further detail.

DETAILED DESCRIPTION OF THE PREFERRED EMBODIMENTS

Figure 1A:
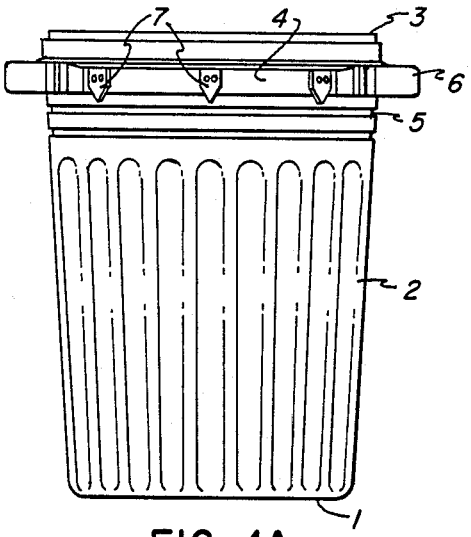
FIG. 1A is an elevation view of a container with attached liner bag penetrating grippers.
Figure 1B:
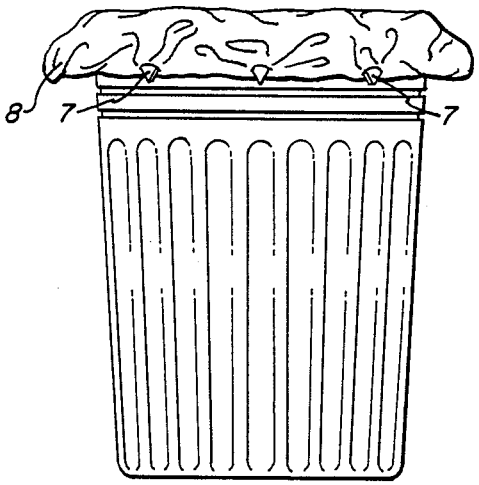
FIG. 1B is a view of a similar container showing a liner bag draped over the rim and handles and held by penetrating grippers.
Figure 2:
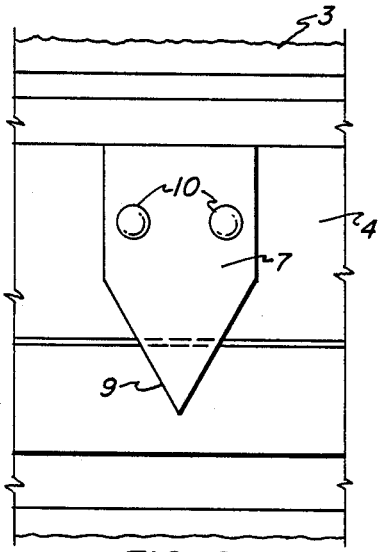
FIG. 2 is an elevation view of a preferred embodiment of a liner bag penetrating grippers.
Figure 3:
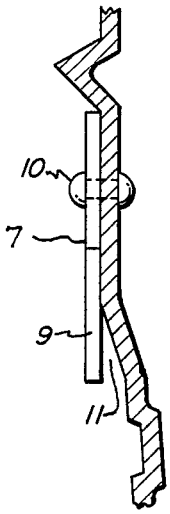
FIG. 3 is a sectional view of FIG. 2.
Figure 4:
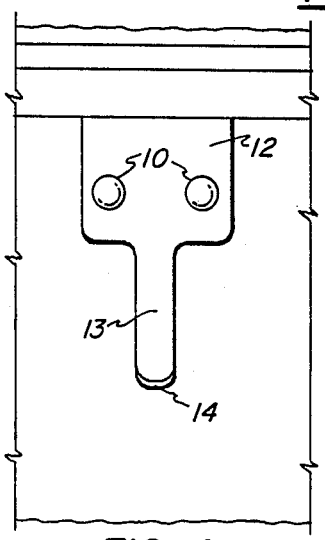
FIG. 4 is an elevation view of another embodiment of the present invention.
Figure 5:
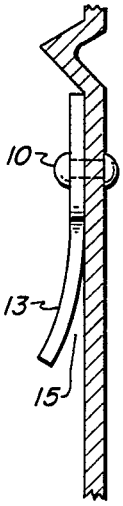
FIG. 5 is a sectional view of FIG. 4.
Figure 6:
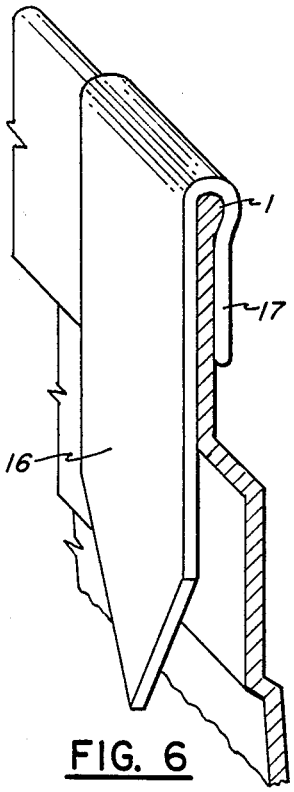

The drawings portray a typical rubbish container as indicated in FIG. 1A and 1B comprising a base 1, upstanding wall 2, and a peripheral rim 3 of the blow molded type. This type of container wall 2 stiffened by band like bulges 4 and grooves 5. As shown the bulge 4 provides a good mounting surface for handles 6. This so-called belt-like bulge is also an ideal mounting surface for the spaced liner bag penetrating grippers 6. Alternate and preferred mounting surfaces can include slightly recessed pockets in the container surface. At FIG. 1-B it shows a liner bag 8 draped over the top of the container and the handles 7 and held by this invention's penetrating grippers. This is accomplished after the liner bag 8 is inserted into the container and is draped over the rim with the outer flap portion extending down the sides of the container wall 2 somewhat below penetrating grippers 7. This relationship of container and penetrating grippers provides an exposed lower tip allowing the liner bag material to be held by one hand under the exposed gripper tips 9 as shown in FIG. 2. The other hand then grasps a portion of liner bag above this same gripper 7. A quick upward pull or jerk easily causes the liner bag to be penetrated. Further upward force causes bag material to wedge at slot 11, FIG. 3 and lock between the gripper 7 and container wall 4. A preferred embodiment of gripper 7 is that they may be made of a flexible plastic type material that enables them to flex outward and this imparts a clip-like grip to the liner bag 8. They may also be flexed outward to release the liner bag from the container. In FIG. 4 and 5 there is shown another version of a liner bag penetrator 12 which provides an outwardly bent bag catching tip to provide a wedge shape slot.

This embodiment could be of more rigid plastic or metal material and have rounded edges. The rounded tip at 14 may create a non perforating bag penetration tip which works well on some bag materials and causes a tenacious grip as this material wraps around the exposed tip 14 and is also trapped behind the gripper tip and in the slot created at 15. These embodiments shown in FIG. 3, 4 and 5 show the grippers mounted by means of rivets 10 with matching holes in grippers and the container. Other mounting methods could include thermo bonding adhesive and stapling.

This invention is directed to an improved holding relationship between plastic liner bags and the bag holder which supports them in an open and upright position for loading and holding contents placed therein. The economical plastic bag has often replaced the rubbish container. The garbage can or wastebasket today in reality often is a liner bag container or holder for the bag which is the container. Merely laying a large amount of liner bag flap over the rim often is not sufficient to prevent the bag from slipping back inside and collapsing and is wasteful of bag material. The present invention overcomes this shortcoming by a positive holding method of actually penetrating and gripping of bag material in a relationship which causes little or no tearing away of the liner bag when stress is applied which might cause it to slip back inside.

It has been found that stamped or molded flat flexible clip-like tabs may be affixed to a container wall in a manner which creates penetrators for impaling bag flap material with a positive locking grip, and a narrowing wedge shaped slot is created as bag flap material is pulled upward and the bag is wedgingly gripped tightly against the container wall. In this arrangement the stress from the downward pull of a liner bag inside the container is oppositely opposed by the bag flap trapped against the outside container wall. Stress over the rim is directly reversed so that much of this tension is transferred and absorbed as friction on the top edge of the rim. Flat downward pointed flexible bag penetrating grippers can lay snugly against the container wall and when it is desired to remove a bag from the container a slight outward finger pressure on the penetrators easily frees the trapped bag flap so that it may be slipped downward and off of the penetrator. This process is quickly repeated for all grippers and the bag is free for removal from the container. The small penetrations of the bag flaps are well above the point where filled bags are gathered above their contents and banded with wire ties, knotted or closed by other means. The points need not be sharp. The number and location of the projections may vary--although six evenly spaced grippers work well for a round container. As many as needed can be affixed to rectangular or other shaped container. They may be applied by the container manufacturer with mass production techniques or special container design modifications may be made such as specially designed mounting surfaces to impart a more compatible and commercially appealing product, rather than having just an "add-on" appearance. They may also be supplied with nuts and bolts for the "do-it-yourself" applications on many types of containers.

It can be seen that this invention develops a new and unique relationship of bag penetrating grippers and liner bag containers for a quick, easy and positive way to hold liner bags in place.

What is claimed is:

1. A container structure for use with a disposable plastic film liner bag in which said liner bag has a closed bottom and an open mouth and said container has means for removably engaging said liner bag in open condition for receiving materials therein, said container structure comprising:

(1) a base;

(2) an upstanding wall portion extending upward from said base and defining an inner container volume, said wall portion having an inner wall surface and an outer wall surface, said wall portion terminating in a rim, said rim defining an opening at the upper end of said container;

(3) a plurality of bag gripping penetrators having a first, attaching portion and a second, wedging and penetrating portion, said first portion attached to said outer wall surface below said rim by attaching means, and said second portion extending downwardly from said attaching portion and outwardly from said outer wall surface so as to form a wedge-shaped opening or slot between said wall surface and said penetrator and said penetrator portion is positioned for deformably engaging a portion of said bag when said bag is inside said container with said mouth folded over said rim and extending over said penetrators and said portion of said bag is further wedgingly engaged in said wedge-shaped opening for securely engaging said bag.

2. The container structure according to claim 1, in which said penetrators are of a flat type material creating a wide gripping surface that tends to deform the bag material without puncturing it.

3. The container structure according to claim 1, in which said penetrators are pointed.

4. The container structure according to claim 1, in which said penetrators are flexible to enhance wedging action.

5. The container structure according to claim 1, in which said second portion of said penetrator has an outwardly bent tip to enhance engaging function.

6. The container structure according to claim 1, in which said outer wall surface includes inwardly curved recess means for attachment of said first, attaching portions of said penetrators.

7. The container structure according to claim 6, in which said recess means further provides improved wedge-shaped openings.

8. The container structure according to claim 7, in which said recess means reduces the exposure of said second portions to accidental contact.

9. The container structure according to claim 1, in which said attaching means includes rivet means.

10. The container structure according to claim 1, in which said attaching means includes thermal bonding.

11. The container structure according to claim 1, in which said attaching means includes staples.

12. Lining bag penetrator means for holding a plastic film bag in place when used to line a container, said container having a base, an upstanding wall portion extending upward from said base and defining an inner container volume, said wall portion having an inner wall surface and an outer wall surface and said wall portion terminating in a rim at its uppermost end, said penetrator means for permanently attaching to said outer wall surface below said rim to removably engage said bag when the body of said bag is within said inner container volume in lining configuration and the mouth of said bag is folded over and past said rim and down over said penetrator means, said penetrator means comprising:

a body portion having a broad attaching face for attaching directly to said outer wall surface by attaching means;

a penetrating portion extending downward from said body portion and outward from said wall surface when said body portion is attached to said wall surface so as to define a wedge-shaped space between said penetrating portion and said wall surface for wedgingly engaging a portion of said bag therein, said penetrating means further including means for deformably engaging a portion of said bag when said bag is pulled against it.

13. The penetrator means of claim 12, in which said penetrating portion terminates in wide flat projections that tend to deform the bag material without puncturing.

14. The penetrator means according to claim 12, in which said penetrating portion is pointed.

15. The penetrator means according to claim 12, in which said penetrating portion is flexible to enhance wedging action.

16. The penetrator means according to claim 12, in which said penetrating portion has an outwardly bent tip to enhance engaging operation.

17. The penetrator means according to claim 12, in which said attaching means includes rivet means.

18. The penetrator means according to claim 12, in which said attaching means includes staples.

* * * * *